US006939279B2

(12) United States Patent
Shea et al.

(10) Patent No.: US 6,939,279 B2
(45) Date of Patent: Sep. 6, 2005

(54) TIRE FOR SKEW REDUCING ROLLER

(75) Inventors: Robert Shea, Bloomfield, NY (US); Michael McMindes, Rochester, NY (US)

(73) Assignee: Ten Cate Enbi, Nuth (NL)

( * ) Notice: Subject to any disclaimer, the term of this patent is extended or adjusted under 35 U.S.C. 154(b) by 0 days.

(21) Appl. No.: 09/846,762

(22) Filed: May 1, 2001

(65) Prior Publication Data

US 2002/0165075 A1 Nov. 7, 2002

(51) Int. Cl.[7] ..... F16C 13/00
(52) U.S. Cl. ..... 492/56; 492/39
(58) Field of Search ..... 492/39, 8, 56, 492/38; 29/895.21; 193/37

(56) References Cited

U.S. PATENT DOCUMENTS

| | | | | | |
|---|---|---|---|---|---|
| 2,450,727 | A | * | 10/1948 | Haushalter | 29/895.21 |
| 2,761,547 | A | * | 9/1956 | Gehrer | 193/37 |
| 3,866,716 | A | * | 2/1975 | Matson | 193/37 |
| 4,110,152 | A | * | 8/1978 | Dunning et al. | 156/553 |
| 4,336,992 | A | | 6/1982 | Szlucha et al. | |
| 4,378,622 | A | * | 4/1983 | Pinkston et al. | 29/895.21 |
| 4,385,683 | A | * | 5/1983 | Krupp | 492/53 |
| 4,436,403 | A | | 3/1984 | Rhodes, Jr. et al. | |
| 4,440,295 | A | * | 4/1984 | Blackwood et al. | 198/843 |
| 4,517,719 | A | * | 5/1985 | Okumura et al. | 492/358 |
| 4,984,778 | A | | 1/1991 | Alexander et al. | |
| 5,044,482 | A | * | 9/1991 | Kramer | 193/37 |
| 5,084,731 | A | | 1/1992 | Baruch | |
| 5,124,756 | A | | 6/1992 | Stelter | |
| 5,133,125 | A | * | 7/1992 | Diebels et al. | 29/895.32 |
| 5,229,813 | A | * | 7/1993 | Cherian | 492/59 |
| 5,278,624 | A | | 1/1994 | Kamprath et al. | |
| 5,415,612 | A | * | 5/1995 | Carlson et al. | 492/56 |
| 5,450,183 | A | | 9/1995 | O'Leary | |
| 5,451,198 | A | * | 9/1995 | Lancaster | 492/48 |
| 5,506,302 | A | | 4/1996 | Shiono et al. | |
| 5,520,977 | A | * | 5/1996 | Snelling | 428/36.9 |
| 5,553,845 | A | | 9/1996 | Sawa et al. | |
| 5,607,039 | A | * | 3/1997 | Byers et al. | 193/37 |
| 5,669,605 | A | | 9/1997 | Sawa et al. | |
| 5,795,087 | A | | 8/1998 | Brower et al. | |
| 5,797,322 | A | * | 8/1998 | Lorig et al. | 492/56 |
| 5,921,539 | A | | 7/1999 | Westcott et al. | |
| 6,032,945 | A | | 3/2000 | Miura | |
| 6,035,163 | A | * | 3/2000 | Zona et al. | 399/176 |
| 6,042,100 | A | | 3/2000 | Jones et al. | |
| 6,059,095 | A | * | 5/2000 | Tsuji | 492/56 |
| 6,213,458 | B1 | | 4/2001 | Tamura et al. | |
| 6,360,662 | B1 | * | 3/2002 | Busshoff | 101/375 |

FOREIGN PATENT DOCUMENTS

| | | |
|---|---|---|
| JP | 05-035110 | 2/1993 |
| JP | 05-105318 | 4/1993 |
| JP | 06-239485 | 8/1994 |
| JP | 06-300039 | 10/1994 |
| JP | 07-010311 | 1/1995 |
| JP | 07-253115 | 10/1995 |
| JP | 08-002939 | 1/1996 |
| JP | 08-143206 | 6/1996 |
| JP | 08169573 | 7/1996 |
| JP | 08-169573 | 7/1996 |
| JP | 08-187900 | 7/1996 |
| JP | 11-181350 | 7/1996 |
| JP | 09-110231 | 4/1997 |
| JP | 11-286348 | 10/1999 |

* cited by examiner

*Primary Examiner*—Marc Jimenez
(74) *Attorney, Agent, or Firm*—Brian B. Shaw, Esq.; Stephen B. Salai, Esq.; Harter, Secrest & Emery LLP

(57) ABSTRACT

A roller assembly for a sheet material transport assembly is disclosed, wherein skewing of the transported sheet material relative to the transport assembly is reduced. The roller assembly includes an elongate shaft having a compliant layer disposed about the shaft. A relatively non-compliant layer is disposed about the compliant layer to form a tire, wherein the non-compliant layer has a circumference, which is substantially unchanged upon operable loading of the roller assembly.

9 Claims, 2 Drawing Sheets

TIRE FOR SKEW REDUCING ROLLER

FIELD OF THE INVENTION

This invention relates generally to roller assemblies for transporting sheet materials such as paper in printers, copiers or the like, and more particularly, to a tire for a roller that can be used in a roller assembly to reduce the tendency of paper to skew while being transported by the roller assembly.

BACKGROUND OF THE INVENTION

Roller assemblies, including tires disposed at longitudinally spaced apart locations on opposed shafts and arranged to contact one another at a nip are commonly used to transport paper or other sheet materials in printers and copiers. Normally, such tires are either hard and relatively non-compliant in which case they must be very precisely aligned and spaced to transport substrates effectively, or, the tires are soft and compliant so that they run in a compressed state thereby reducing the requirements for accurate alignment and spacing.

To accommodate substrates of varying width, it is common to provide a pair of shafts each of having a plurality of tires thereon. The longitudinal spacing between the tires is set so that the narrowest substrate is transported by at least two tires, wherein additional tires contact progressively wider substrate.

Typically, the shafts are supported only at their ends. If non-compliant tires are used, not only must the shafts be maintained in a precisely parallel orientation, but the shafts must be sufficiently rigid to preclude the shaft from bowing, even as the substrate passes through the nip. Providing such shafts that are sufficiently straight and rigid, and aligning the shafts is difficult and increases cost while decreasing the reliability of transport mechanisms using non-compliant tires.

In an effort to overcome these problems, compliant tires that significantly deform at the nip have been employed. When confronting compliant tires deform, the radius of the tire changes and this reduces the speed at which the substrate is transported through the nip. When multiple compliant tires are mounted on a single shaft, and the spacing between the shaft is not uniform across the length of the shaft, or the amount of compression of the compliant tires differs from one tire set to the next, speed differentials between the tire sets are created that cause the substrate, such as the paper to skew.

Compliant tires have another disadvantage. Because the compliant tires contact the paper at a contact patch that has different radii relative to the shaft across the length of the contact patch, the speed of the tire surface relative to the shaft changes while the tire contacts the substrate and this creates a scrubbing action between the tire and the substrate that scuffs the paper and wears the surface of the tire. Scuffing of the substrate is particularly troublesome when printed or copied images are present on the substrate or with substrates that will be printed after transport. Printing is adversely effected by damage to the surface caused by scuffing.

Thus, both known tire constructions, compliant and non-compliant, create problems. Non-compliant tires must be very precisely manufactured and aligned. Tolerances in shaft spacing of 0.002" are generally considered to be required. Non-compliant tires require hand installation and mounting, which further increases costs. In addition, the criticality of alignment requires frequent maintenance. While compliant tires place less strict requirements on alignment, the compliant tires introduce the problems of skewing and scuffing.

Therefore, a need exists for a sheet material transport system that overcomes these problems, reduces wear on the tires and scuffing of the paper, and is easy to manufacture and maintain in alignment. There is a further need for a roller that can be readily manufactured to include a plurality of tires. A need also exists for a roller that provides the advantages of non-compliant tires and compliant tires without the associated disadvantages.

SUMMARY OF THE INVENTION

The present invention provides a roller for transporting a sheet material substrate along a path, wherein skew and scuffing of the substrate is reduced. As used herein, skew is generally defined as the turning of a sheet by the transport assembly to a non-aligned orientation. Typically, the skew results in the direction of the travel of the sheet being non-parallel to a corresponding axis, or dimension of the sheet. That is, if the sheet is rectangular with the longitudinal axis parallel to the travel path, skew results, as the longitudinal axis becomes non-parallel to the travel path.

Briefly stated, the present invention encompasses a roller including a shaft and at least one tire mounted on the shaft, the tire having a compliant core and a substantially non-compliant layer on the core.

In a preferred construction of the roller and in an unloaded (concentric) state, the shaft, the compliant core and the non-compliant layer are concentric. Upon operable loading of the roller, the shaft is offset to an eccentric position with respect to the compliant core and the non-compliant layer. As the compliant core extends between the shaft and the non-compliant layer, the amount of offset is accommodated by the compliant core. Thus, a portion of the core is compressed and a separate portion of the core is expanded or stretched. The effective axis of rotation of the non-compliant layer and the compliant core remains concentric upon imposition of the offset. However, as the shaft is offset from the concentric axis, the portion of the compliant core intermediate its shaft and the nip is compressed, while the diametrically opposed portion of the compliant core is stretched.

Thus, for a given radius of compliant core extending between the shaft and the non-compliant layer, the radius will shorten as it rotates to a position between the shaft and the nip. Further rotation will cause the radius will return to the concentric radius dimension. Upon continued rotation, the radius will then elongate as it becomes diametrically opposed to the nip. Upon further rotation, the radius will then shorten to the concentric radius length. Finally, the radius will shorten to be less than the concentric radius length upon rotating between the shaft and the nip.

In accordance with another aspect of the invention, the compliant core includes a foam material, and preferably an open cell material. In accordance with another aspect of the invention, the non-compliant layer comprises a layer of elastomeric material. In one construction of the non-compliant layer, the layer has a durometer of less than 60 Shore A.

DETAILED DESCRIPTION OF THE PREFERRED EMBODIMENTS

Figure 1:
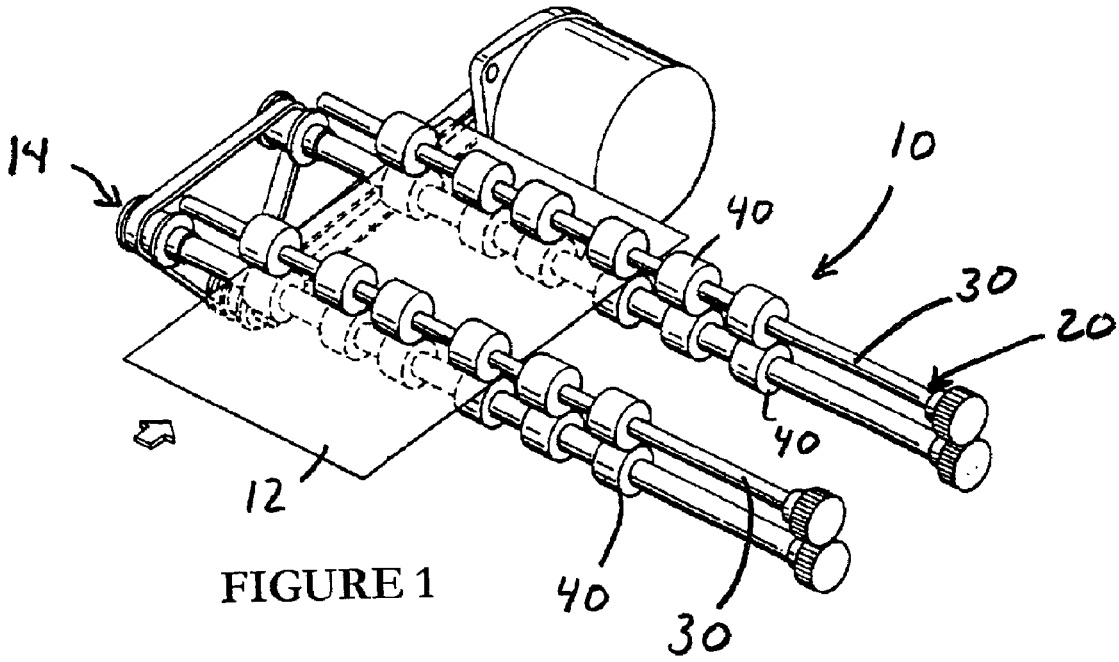
FIG. 1 is a drawing of a paper transport mechanism employing the present roller assemblies.

Referring to FIG. 1, a roller assembly 10 for transporting a sheet of material such as a sheet of paper 12, an image forming substrate or the like is shown. The roller assembly 10 encompasses a roller 20 having a shaft 30 and a tire 40 affixed to the shaft. Typically, the roller assembly 10 includes a roller 20 and an opposing surface for forming a nip. The opposing surface can be a roller 20, a drum, a sleeve or sufficiently lubricious material to preclude grabbing of the substrate.

Assemblies of the type described are commonly found in printers, copiers, and fax machines, scanners, fabric printers and similar devices. However, it should be understood that the roller assembly 10 is not limited to any particular device or even to the devices just mentioned but is usefully employed in any application where it is necessary to move sheets of material from one location to another.

As show in FIG. 1, the roller assembly 10 includes two sets of generally parallel rollers 20 with corresponding shafts 30 supported on bearings, (not shown) and driven by a drive mechanism 14. Each of the rollers 20 has a plurality of tires 40 mounted thereon.

The shafts 30 are preferably made of steel but one of the advantages of the invention is that the shafts need not be completely straight and therefore can be made of a material other than steel such as aluminum, plastic composite, or the like. It is believed variances in straightness of the shaft 30 of 0.03 inches per linear foot can be accommodated by the present construction. Plastic shafts may flex more than steel shafts of the same size but the tires 40 of this invention accommodate such flex without significantly increasing skewing of the paper 12. The tires 40 are arranged in confronting pairs and spaced along the respective shaft 30 so that sheets of material 12 transported by the roller assembly 10 engage at least two tires for maintaining the alignment of the material passing through the transport assembly.

Typically, the shafts 30 are supported by bearings or the like, wherein the bearings are adjustable to maintain the shafts in a parallel relation and to maintain the spacing between the shafts at a designed value so as to minimize skew. The shafts 30 can be biased or loaded to urge the opposing rollers 20 into contact. Typical loading can be accomplished by springs, hydraulics or cams. Thus, the roller 20 is biased at the nip. The roller is thereby placed in a loaded or biased position.

Figure 2:
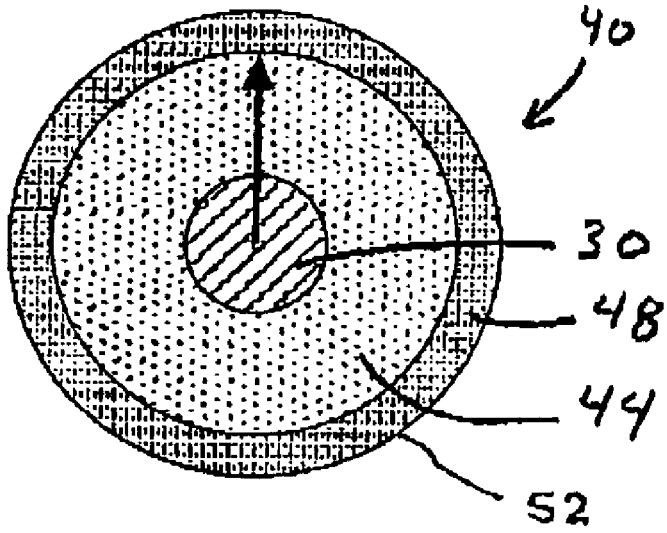
FIG. 2 is a side view of a roller for use in a paper transport mechanism.

FIG. 2 is a side elevation of a roller assembly showing the tire 40 for use in a roller assembly 10. The arrangement of the roller assembly 10 of this invention is substantially that shown in FIG. 1 combined with the roller construction shown in FIG. 2.

In its simplest form, a tire 40 for the roller includes the compliant core 44 surrounding the shaft 20, and the layer of non-compliant material 48 surrounding the compliant core. Although not required, a hub can be located intermediate the compliant core and the shaft. The hub can be a relatively rigid sleeve and formed of a variety of materials including, but not limited to metal, plastic or composites. The hub can be used to reduce the amount of compliant material necessary to fill the annular space between the shaft 30 and the non-compliant layer 48.

The tire includes a compliant core 44 and an outer non-compliant layer 48. The compliant core 44 is affixed about the shaft, or a hub, and the non-compliant layer 48 is disposed about the compliant core, so as to surround the core. In a preferred construction, the compliant core 44 is fixedly attached relative to the shaft and the non-compliant layer 48 is fixedly attached to the compliant core.

Figure 3:
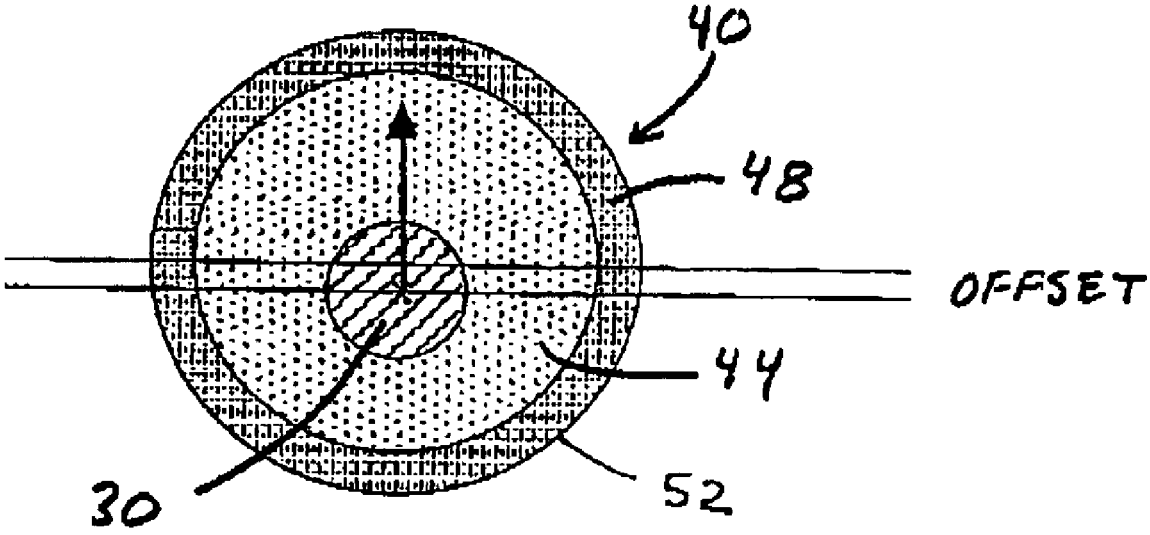
FIG. 3 is a side view of a roller showing an offset to provide operable loading of the roller.

A tire 40 that deforms significantly at the nip is referred to as a compliant tire, whereas a hard tire, which does not deform significantly at the nip, is understood to be non-compliant. As used herein, compliant means having a tendency to deform significantly in use, particularly in a roller assembly 10, while non-compliant means having a tendency to deform no more than insubstantially in use, particularly in a roller assembly. The compliant behavior can be understood by referring to FIG. 2 and 3. FIG. 2 depicts the tire 40 in the unloaded (concentric) state. FIG. 3 depicts the tire 40 a loaded state in which the compliant core 44 is deformed. While the sheet material 12 is not shown in FIG. 3, it is clear that the contact between the tire 40 and the sheet material 12 must be at the lowest point of the drawing, since the non-compliant layer is offset upward. FIG. 3 is a "snapshot" of the tire 40 in a single position of the loaded state. Clearly, as the tire 40 rotates, the compliant layer 44 will experience continual deformation to accommodate the illustrated offset.

It is understood the tendency of a material to exhibit the characteristics referred to herein as compliant or non-compliant depends on the structure and materials used for the other elements of the invention. That is, the relative hardness of the two materials used to construct a tire 40 in accordance with the invention will determine the extent to which each material deforms during use and therefore the extent to which each material is either compliant or non-compliant. If a very soft material is used for the core 44 of the tire 40, and that material has a tendency to deform easily in use, then a moderately hard material can be used for the non-compliant layer 48 without exhibiting any substantial deformation in ordinary use in a roller assembly in accordance with the invention. When a harder compliant core material, which resists deformation is used, a harder layer non-compliant material can be used to substantially eliminate deformation. It will be appreciated that the relative hardness of the materials as well as the characteristics of the materials themselves determines whether the materials will be compliant or non-compliant as those terms are used herein. In addition to the absolute and relative hardness of the materials, the thickness of the compliant core 44 and non-compliant layer 48 also effect the extent to which deformation occurs during use. For example, a relatively thick compliant core 44 will deform more than a thinner compliant core made from the same material. Similarly, a thicker non-compliant outer layer 48 will deform less than a thinner non-compliant outer layer made from the same material.

The non-compliant layer 48 is selected to exhibit a cross sectional profile in an unloaded state, wherein the profile is substantially precluded from changing during operation. That is, as the shafts 30 are biased, thereby urging opposing tires 40 against each other, while the complaint core is sequentially stretched and compressed upon operable loading the profile of the non-compliant layer 48 is unchanged in that it does not deform at the nip.

An outer most surface 52 of the tire must also provide a sufficient coefficient of friction to effectively transport the sheet material 12. In applications where paper is transported, the non-compliant layer 48 is preferably a natural or synthetic elastomer such as rubber or a synthetic polymer. Preferably, the surface 52 of the non-compliant layer 48 has a durometer not greater than approximately 60 Shore A, so as to provide a suitable coefficient of friction relative to a sheet of paper. More preferably, the non-compliant layer 48 has a hardness between 35 and 60 Shore A.

In one embodiment, the non-compliant layer 48 is a relatively rigid metal or plastic tube. The tube can have a thickness of about 0.020 inches or greater. The outer surface 52 of the tube is preferably roughened or coated with a high co-efficient of friction material. The coating should preferably be relatively thin compared with the radius of the compliant core 44. A thin coating having a thickness of about of 0.020 inches has been found effective. Additional layers of material can be applied to the outside of the non-compliant layer 48 to enhance the ability of the roller 40 to transport particular materials. For example, a relatively thin layer 52 of soft material such as a soft rubber maybe applied to the outside surface of an otherwise slippery non-compliant layer 48. Preferably, the soft rubber layer is sufficiently thin to preclude any deformation which introduces a significant change in the circumference or deformation of the tire 40 and hence tendency to produce scrub.

The non-compliant layer 48 is selected to minimize any circumferential elongation upon loading or in use. That is, the circumference and cross sectional profile of the non-compliant layer 48 is constant. In contrast, the inner compliant core may experience a circumferential elongation (shear) in use as well as radial expansion and contraction. However, this elongation (shear distortion) and expansion/contraction is not transmitted to the sheet material 12, as the non-compliant layer 48 is disposed at an intermediate position.

The tire 40 is mounted to the shaft 30 by affixing the compliant core 44 relative to the shaft, or hub if used. The non-compliant layer 48 is affixed relative to the compliant core 44. In the unloaded position, the shaft 30, the compliant core 44 and the non-compliant layer 48 are concentric.

Upon operable location of the roller 20, and hence tire 40, the shaft 30 is offset from the concentric position to an offset position. The amount of offset is termed the offset distance.

The loading or bias necessary to maintain the offset is such that upon rotation of the shaft 30 the loading force on the shaft remains substantially constant. It is understood the loading force can increase when a substrate passes through the nip. However, the loading of the shaft 30 can be selected to accommodate the increase associated with passage of a substrate through the nip. The present tire 40 and roller 20 can accommodate any type of loading or biasing structure.

Therefore, upon loading (and during operation) for a given location on the non-compliant layer 48 the radius between the shaft and the given location continuously varies as the shaft and hence non-compliant layer rotates. The mechanism to accommodate the continuously changing radius is the complaint core 44, which is sequentially stretched and compressed as the tire 40 is rotated. Specifically, the radius between the shaft 30 and the non-compliant layer 48 is a constant concentric radius prior to loading, biasing or offsetting the shaft. Upon operable loading, the shaft 30 is displaced from the concentric position by the offset distance. Thus, during operation, while the diameter of the non-compliant layer 48 remains constant, the radius to the shaft varies from the concentric radius to the concentric radius plus the offset distance, to the concentric radius, to the concentric radius minus the offset distance, then to the concentric radius.

Therefore, upon rotation of the tire 40 in the loaded state, a given annular section of the compliant core 44 continually varies in cross sectional area. In contrast, the cross sectional area of an annular segment of the non-compliant layer 48 has a smaller variation in cross-sectional area, and preferably has a constant cross sectional area upon rotation in the loaded state.

Because the compliant layer core 44 continuously flexes during operation, heat is generated within the core. Therefore, a foam material, and preferably an open cell foam material can be used. Foam material has relatively low thermal hystersis and therefore generates relatively little heat when it is repeatedly flexed. Open cell foam material dissipates heat more easily than closed cell material and therefore is most preferred when used in a high speed or high-pressure application.

Referring to FIG. 3, upon operation in the compressed state, the non-compliant layer 48 forms a nip that is significantly more curvilinear than a comparable nip formed by the material of the compliant core. A substantial portion of the bias resulting from offset of the shaft is concentrated in the compliant core. As the non-compliant layer 48 maintains its circumferential dimension and configuration upon operable loading, the resulting speed of the tire surface is constant.

The compliant core 44 and the non-compliant outer layer 48 are preferably selected so that they can be easily attached to the respective surfaces. While a variety of techniques can be used, it has been found that the layers can be glued together. That is, the foam compliant core 44 can be glued to a hub adapted to be attached to the shaft and the non-compliant layer 48 can be glued or bonded to the outside of the compliant layer 44.

Alternatively, the non-compliant layer 44 can be extruded, the hub positioned therein, and the foam compliant layer 44 formed in place in the annulus between the hub and the non-compliant layer 48 using techniques well known to those skilled in the art. As another alternative, the compliant and non-compliant layers 44, 48 can be co-extruded directly on a hub 50.

While a variety of different materials can be employed in roller assemblies in accordance with this invention, applicant has successfully used 4 lb/ft$^3$ thermal reticulated polyester urethane with a 100 cells per inch count as the material for the compliant core 44. A variety of materials can be used for the non-compliant layer 48. Applicant has successfully employed an EPDM having a hardness of 60 Shore A as the material for the non-compliant layer. The particular monomer is available from Ten Cate Enbi as No. I6.45.01.1.

EXAMPLE 1

Compressed Nip Test

A tire 40 in accordance with this invention was constructed having a compliant core 44 constructed from 4 lb/ft$^3$ polyurethane foam glued to a hub. A 0.160" thick layer of synthetic elastomer having a durometer of 60 the Shore A was glued to the outside of the core.

A test fixture was constructed as a 1" diameter ×12" long steel idler roller. A pair of tires 40 constructed as described were attached to a 12" long 0.375" diameter shaft 30 spaced from the 1" steel roller. The shaft 30 carrying the tires 40 was adjusted so that the tires bore against the 1" steel shaft and deflected 0.050". The tires were driven at 100 rpm for 120 hours and the foam and glue were then visually inspected. No damage or wear was observed to any of the parts.

EXAMPLE 2

Radial Torque and Compressed Nip Test

The idler roller was removed and a wood block was substituted. The wood block was arranged on the end of a lever arm to apply 12 oz. of force between the surface of the block and the surfaces of the tires. The tires 40 were rotated for 120 hours at 100 rpm and the tires were visually inspected. The glued interface between the compliant core 44 and the non-compliant outer layer 48 was not damaged. The outer surface of the non-compliant layer 48 showed a loss of 0.012" in radius due to wear caused by rubbing on the wood block.

EXAMPLE 3

Paper Skew Test

A test fixture was arranged with two tires spaced 4.00" apart on the 0.375" diameter shaft. The shaft was adjusted relative to the 1" steel idler roller so that one of the idler tires was offset, compressed 0.050" while the other roller was offset, compressed 0.010". This produced a difference in compression of 0.040". A sheet of paper 8" wide and 11" long was aligned against a paper edge guide and run through the nips between the two driver tires and the idler tire. The distance from the edge of the paper to the paper edge guide downstream of the drive mechanism was measured. The test was repeated 10 times and the total variation over the 10 tests was 0.009". The average of the 10 tests showed skew below a measurable amount. The test was repeated with opposite compressions and with equal compressions and produced substantially the same results.

While the invention has been described in connection with the presently preferred embodiment thereof, those skilled in the art will recognize that many modifications and changes may be made therein without departing from the true spirit of the scope of the invention which accordingly is intended to be defined solely by the appended claims.

What is claimed:

1. A roller for a roller assembly as used in transporting a sheet material, through a nip formed between the roller and an opposed surface the roller comprising:

a) a shaft;

b) a first tire mounted to the shaft, the first tire including i) a compliant core fixed to the shaft for rotation with the shaft, the compliant core composed of a compressible open cell foam and ii) a non compliant outer layer fixed to the core for rotation with the core, c) the circumference and diameter of the non compliant outer layer remaining substantially constant as the outer layer rotates against an opposed surface to create the nip; and d) the compliant core allowing radial displacement of the outer layer relative to the shaft as the outer layer rotates against an opposed surface.

2. The roller of claim 1, wherein the open cell foam comprises polyurethane.

3. The roller of claim 1, wherein the non-compliant layer has a durometer less than 60 Shore A.

4. The roller of claim 1, wherein the non-compliant layer has a durometer greater than 35 Shore A.

5. The roller of claim 1, wherein the non-compliant layer has a durometer greater than 35 Shore A and less than 60 Shore A.

6. The roller of claim 1, wherein the non-compliant layer includes a metal tube.

7. The roller of claim 6, comprising a layer of coefficient of friction enhancing material on the metal tube.

8. The roller of claim 1, wherein the non-compliant layer comprises a plastic tube.

9. The roller of claim 8, comprising a layer of coefficient of friction enhancing material on the plastic tube.

* * * * *